United States Patent [19]

Schiessl et al.

[11] 3,979,850

[45] Sept. 14, 1976

[54] SAFETY SYSTEM FOR HANDGUNS

[75] Inventors: Alois Schiessl, Weissbach-Marzoll; Rüdiger Van Acken, Mullheim, both of Germany

[73] Assignee: Firma Buck K.G., Germany

[22] Filed: Apr. 30, 1975

[21] Appl. No.: 573,023

[30] Foreign Application Priority Data

May 10, 1974 Germany ..... 2422663
Oct. 11, 1974 Germany ..... 2448586

[52] U.S. Cl. ..... 42/71 P; 42/70 E
[51] Int. Cl.[2] ..... F41C 3/02; F41C 19/00; F41C 23/00
[58] Field of Search ..... 42/1 G, 1 Z, 72, 73, 42/71 P, 75 D, 71 R, 70 E

[56] References Cited

UNITED STATES PATENTS

| | | | |
|---|---|---|---|
| 2,462,091 | 2/1949 | Garand | 42/72 |
| 3,269,046 | 8/1966 | Schaefer | 42/70 E |
| 3,583,088 | 6/1971 | Buck et al. | 42/1 R X |
| 3,619,930 | 11/1971 | Beermann et al. | 42/1 Z X |
| 3,798,819 | 3/1974 | Hillberg | 42/72 |
| 3,913,482 | 10/1975 | Schiessl et al. | 42/1 Z X |

*Primary Examiner*—David H. Brown
*Attorney, Agent, or Firm*—Burns, Doane, Swecker & Mathis

[57] ABSTRACT

There is disclosed a handgun intended for one-time use for launching a projectile. The gun is stored in a condition wherein a handle of the gun is folded to cover the trigger. A releasable locking member locks the handle in its folded position. In its folded position, the handle biases a pair of knobs inwardly to prevent actuation of the trigger, while a portion of the trigger engages the firing pin to prevent movement of the firing pin. In the stored condition of the handgun, the firing pin is uncocked and is unable to be moved into a cocked position. The locking member has a guide portion which is slidable within a bore containing the firing pin and its biasing spring. The guide portion acts as an abutment and a guide for the rear end of the spring. In one embodiment of the invention, the locking member is cammed inwardly by the handle as the handle is unfolded, to automatically cock the firing pin spring. In another embodiment of the invention, the spring is cocked during actuation of the trigger, with the firing pin being automatically released after a predetermined movement of the trigger. A separate safety member can be provided to secure the firing pin against cocking movement even when the handle is unfolded. This safety member can comprise a rotatable bolt which is held against rotation by the handle when the handle is in a folded position. Alternatively, this safety member can comprise a slide which is held by a leaf spring in its safety and released positions, and which can be cammed to its safety position by the handle if the handle is shifted from an unfolded to a folded position.

16 Claims, 13 Drawing Figures

SAFETY SYSTEM FOR HANDGUNS

BACKGROUND AND OBJECTS OF THE INVENTION

The invention relates to a handgun, especially for projectiles or ammunition for projectors with an illumination, fog, smoke, tear gas, fire or explosion effect. More particularly, the invention relates to handguns of such type in which the parts of the gun are unfolded for use and wherein the gun can be disposed of after one-time use.

Such guns typically include a swiveling handle which, in a swiveled-in or folded position, covers up the trigger and which in a swiveled-out or unfolded position (i.e., swiveled by about 90° in relation to the folded position), can be fixed in position. Such devices are light, cheap, consumable devices which in most cases are thrown away after a one-time use. They consist of a pipe made of cardboard, plastic or aluminum which contains the mass to be propelled, and of a hand firing device having the swiveling handle, primer percussion cap, and ejector.

Known handguns of this type frequently have a more or less precocked striker spring. That has the disadvantage that after a long time of storage, firing duds can occur because of the fatigue of the striker spring in consequence of too small a spring power. Also, many times a precisely determined cocking path of the firing pin is not guaranteed, which can contribute likewise to firing duds in consequence of variable spring pressures.

Also, the safety arrangements of known devices of this type do not do full justice to the requirements made of them. In the case of known devices, the firing arrangement is ready for firing after unfolding the swiveling handle. That can lead to accidents whenever, for example, the rifleman moves crouched in rough terrain with the handle unfolded. Also, the tensioning of the firing pin by the trigger on its front side, whereby the firing pin is not secured against reverse movement, can lead to an unintended cocking and release of the shot. In case of thrust on the device in an axial direction onto its rear end, the striker spring can be cocked automatically by the firing pin. Whenever in that case the firing pin is impelled forward, release of the shot can take place as a result of a break of the cocking finger of the trigger or also whenever, because of the force of inertia, the cocking finger has slipped out of its locking position.

A lock for the swiveling handle in its unfolded position, which would safely withstand the not inconsiderable recoil of the device, is also important. In one known arrangement, a locking button engages with a recess disposed on one side of the handle piece. As a result, the swiveling handle and the housing are loaded on one side as a result of the recoil. Upon firing of the device, this can lead to breaks in the material of the handle piece or of the housing and to a failure of the locking mechanism which, as a consequence, could lead to injuries of the marksman.

The invention is based on the task of developing a handgun of the initially stated type in such a way that the above-mentioned disadvantages will be avoided with simple constructional formation of the device parts. It is also an object to increase safety of the device with easy handling as well as to guarantee a constant striking force of the firing pin even in the case of a low precision manufacturing of the individual device parts.

SUMMARY OF THE DISCLOSURE

As a solution of these tasks according to the invention, a locking member locks the swiveling handle in its folded position. The locking member is guided slideably in the bore for the firing pin. It fits against the uncocked spring of the firing pin and it constitutes a guide for the rear end of such spring.

The locking member has at its rear end a pressure plate which closes the housing rearwards in a tight manner and is developed on its rear side in the form of an arc in such a way, that upon unfolding of the swiveling handle, the arc surface is compressed by a stop edge of the handle. When the handle is unfolded, the locking member again protrudes into the blocking position.

The shifting path for the locking member is limited effectively by the axis of the swiveling handle which projects into an upper recess of the locking member.

For the purpose of locking the swiveling handle in its unfolded position, there are effectively two locking knobs or buttons under pressure from one common spring. The buttons are supported in a pressed-in position in the case of the unfolded swiveling handle, by inside lateral walls of the handle. These locking buttons in a pressed-in position will lock the cocking movement of the cocking trigger, developed as a sled-shaped triggering slide.

In its front part the trigger has a driver or latch swivelable around an axle. The latch is supported by a guiding surface of the housing and has a projection which fits into an annular groove of the firing pin. The rear surface of the projection and/or the rear surface of the annular groove is beveled in order to make possible a camming or swiveling-out of the latch from the firing pin, whenever the latch is disengaged from the guiding surface of the housing.

The trigger in the rear has a recess which, upon its pulled-back position, overlaps the pressure spring for the locking buttons.

For the purpose of securing the firing pin even further against a cocking movement, the device has a safety member which in one securing position secures the firing pin against a cocking movement when the handle is unfolded. The safety member can comprise a rotatable bolt provided with a bevel. The bolt has a lever which, when the swiveling handle is folded, is locked against rotation by the handle.

The safety member of the firing pin can also consist of a slide which is held by a leaf spring in two terminal positions. Upon a folding of the swiveling handle over the trigger, the slide is guided back into the locking position by engagement of the swiveling handle with a slanted surface portion of the slide.

In an effective further embodiment of the device, the swiveling handle has an attachment which, during unfolding of the handle, forces the locking member into a position cocking the spring of the firing pin. When the handle is fully unfolded, the swiveling handle holds the locking member firmly in this position. Then upon firing, the cocking force for the spring of the firing pin need not be produced by the finger operating the triggering lever, which in case of a relatively hard spring for the firing pin is bothersome and can easily lead to jerking the device out of the intended direction of the slot. The locking element for the swiveling handle cannot return again into its starting position so as to relieve the spring for the firing pin after the handle has been unfolded. The cocking of the spring for the firing pin therefore takes place during the unfolding of the swiveling handle and the force needed for firing in the case of the operation of the release lever is relatively small, so that a greater precision of the shot can be achieved.

In a further improvement, the device has a release lever swivelably articulated on the housing below the guide bore. The lever has an eccentric curved surface which engages a shiftable release slide for the firing pin. The release slide is slidable parallel to the guide bore carrying the firing pin. On the front part of the release slide, a swivelable latch is mounted. This latch is supported in the first part of the return movement of the release slide on a guiding surface of the housing, during which the fixing element engages with the firing pin. The release lever effectively penetrates a central slit of the release slide. As a result of that, canting forces acting upon the release slide are eliminated. The firing pin can have an annular groove with which the fixing element engages. This will prevent the firing pin from moving backwards upon striking of the device with its rear end because of the inertia force and in that a shot can be released unintentionally in case of a possible break of the locking member.

THE DRAWINGS

Preferred embodiments of the invention are illustrated in the drawings as examples.

DETAILED DESCRIPTION

Figure 1:
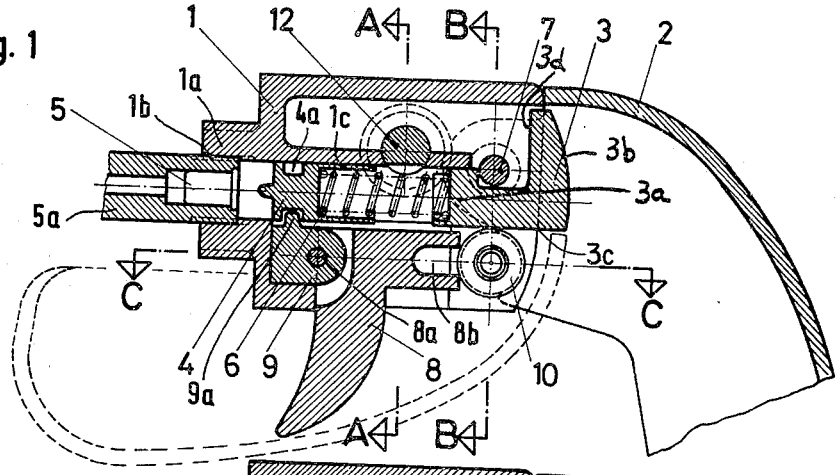
FIG. 1 is a longitudinal section through the ignition arrangement of the handgun according to the invention with the swiveling handle being in an unfolded position and with the firing pin being in its rest position.

The housing 1 of the handgun has an externally threaded flange 1*a* for connection of an internally threaded pipe (not shown) containing the projectile ejector charge. The flange 1*a* is internally threaded for the reception of a receiving body 5*a* containing a primer percussion cap 5. In a bore 1*c* of the housing which extends rearward and contains the inside threads 1*b*, a bell-shaped firing pin 4 is guided. The pin 4 consists of plastic or brass and is provided with a safety annular groove 4*a*. In the rear part of the housing a swiveling handle 2 is mounted on a swiveling handle axle 7. A shiftable locking member 3 is provided which includes a guide portion 3*a* and a pressure plate 3*b*. The guide portion 3*a* is slidably mounted in the guide bore 1*c* for the firing pin. The locking member 3, in its rearwardly shifted position has a shoulder 3*c* that locks the swiveling handle against unintended unfolding from its folded position (see broken line folded position of FIG. 1) against the housing 1. The pressure plate 3*b*, which constitutes an upward extension of the locking member 3, can be formed in such a way that it will tightly close the pertinent guide opening of the housing 1 in order to prevent a fouling of the inside of the housing. A recess 3*d* on the upper side of the locking member 3 is intended to accommodate passage of the axle 7 of the swiveling handle and is dimensioned in such a way that the axle for the swiveling handle forms an abutment limiting the rearward movement of the locking member and limits its forward movement in case of pressing in when the handle is unfolded. A spring 6 for the firing pin is guided at its front part in a rear recess of the firing pin 4 and at its rear part in a bell-like depression of the guide portion 3*a* of the locking member 3. When the device is stored, the spring is completely relieved (i.e., the firing pin is uncocked (FIG. 1)).

Figure 2:
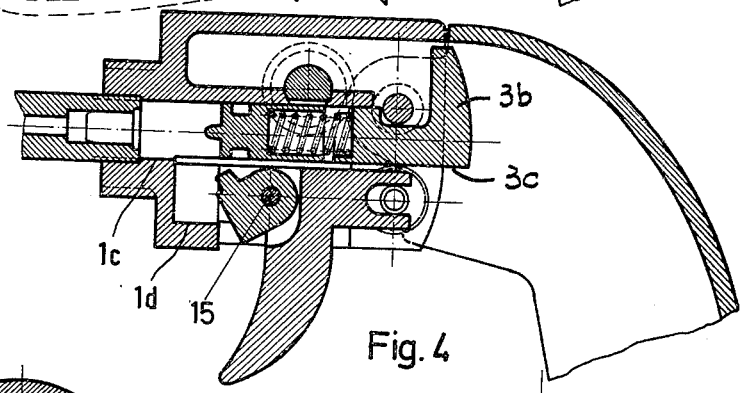
FIG. 2 is a longitudinal section similar to FIG. 1 in which the release slide is retracted and the driver has released the firing pin.

A trigger 8 has a manually actuable portion guided slideably in the manner of a slide in a corresponding recess of the housing 1. At its front end it has a driver or latch 9 swiveled around an articulated axle 8*a* carried by the manually actuable portion. The latch 9 has a projection 9*a* which engages an annular groove 4*a* of the firing pin 4 and is supported by a gliding surface 1*d* of the housing. The surface 1*d* is closed-off in front. The rear surface of the projection 9*a* is beveled so that, whenever the driver 9 is pulled back, the latch 9 of the trigger 8 comes free of the gliding surface 1*d*. Before coming free of the gliding surface, the latch 9 cocks the firing pin. When the latch 9 leaves the gliding surface, the forwardly-urged firing pin cams the latch 9 downwards (FIG. 2), thereby releasing the firing pin. In order to produce a component of force causing this downward swiveling out of the latch 9, the rear surface of the annular groove 4*a* can be beveled instead of the rear surface of the driver extension, or else both surfaces can be beveled.

Figure 5:
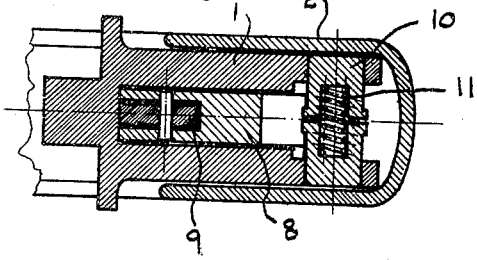
FIG. 5 is a longitudinal section along line C—C of FIG. 1.

For locking the swiveling handle 2 in readiness to fire, two locking knobs or stop knobs 10 have been provided. These knobs 10 are under the action of a pressure spring 11 disposed between them and are supported by the inside lateral walls of the swiveling handle when the swiveling handle 2 is in a folded posture (FIG. 5). The locking knobs consist of plastic or metal and have the shape of a hat or cup. In a pressed-in position, they sit behind the release trigger 8 and lock it against any rearward cocking movement.

Figure 3:
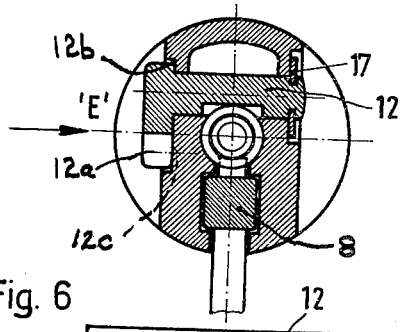
FIG. 3 is a cross section along line A—A of FIG. 1.
Figure 4:
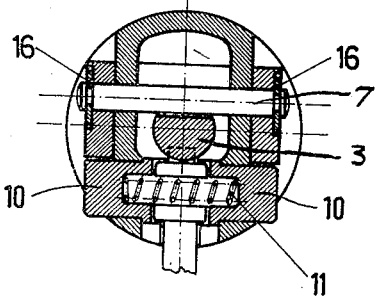
FIG. 4 is a cross section along line B—B of FIG. 1.

The handgun arrangement is provided with an additional safety member for the firing pin 4 which, in a safety position, locks the firing pin against rearward movement. In the case of the embodiment according to FIGS. 1 to 6, the safety member consists of a rotatable, partly flattened bolt 12, which is equipped at one end with a small lever 12*a*. When the swiveling handle 2 is in a folded position, it locks the lever 12*a* against rotation. (See the broken line positions of members 12*a* and 2 in FIG. 6.) In the case of rotation of the bolt 12 by 90°, the flat part will release the firing pin 4. A small recess 12*b* about 2 mm deep in the left-hand side of the housing is dimensioned such that it will limit the rotatability of the lever 12*a* (FIG. 3). The lever 12*a* on its side facing the housing has a projection nipple 12*c* which in both terminal positions of the lever engages corresponding depressions of the housing.

Figure 7:
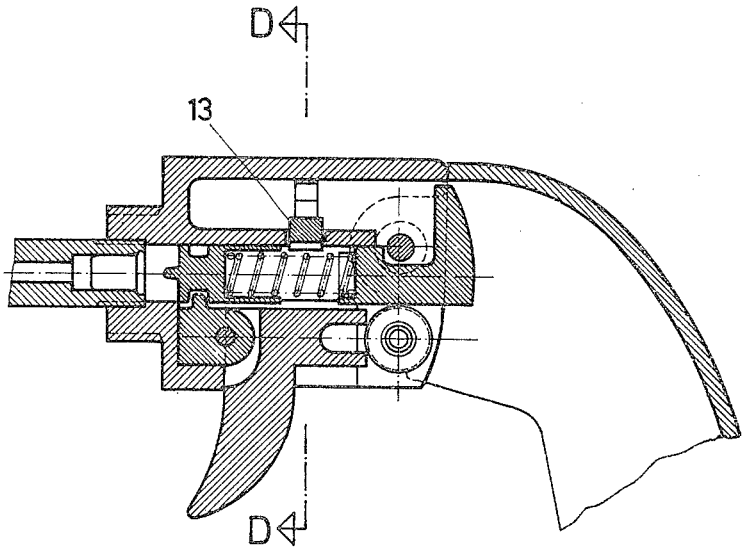
FIG. 7 is a longitudinal section of a handgun having a varied locking member for the firing pin.
Figure 8:
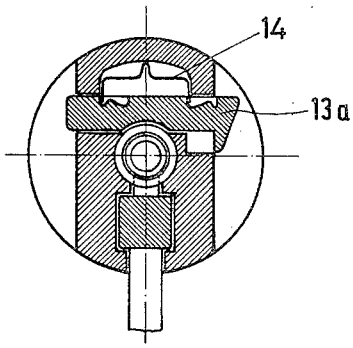
FIG. 8 is a cross section along line D—D of FIG. 7 with the safety member being in a firing position.
Figure 9:
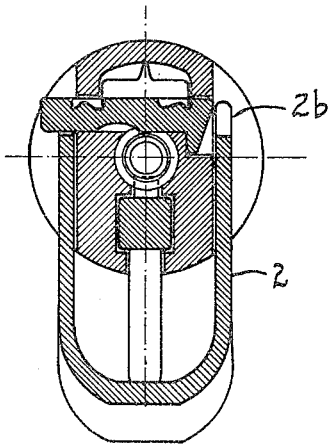
FIG. 9 is a cross section along line D—D of FIG. 7 with the safety member being in a safety position.

In the case of the embodiment according to FIGS. 7 to 9, the safety member consists of a slide 13, slideable in a corresponding guide groove of the housing which is somewhat longer (e.g. 8mm) than the housing is wide. The lower side of the slide 13 has provided with a curved recess which, in the case of an unlocking position of the slide (FIG. 8), releases the gliding path of the firing pin, whereas in a locking position of the slide (FIG. 9), a part of said slide projects into the gliding path of the firing pin. On the top side of the slide 13, there are two recesses which receive the ends of a leaf spring 14. The spring 14 retains the slide 13 in both terminal positions of FIGS. 8 and 9. The slide 13 has an extension 13*a* on its right-hand end which is provided with a slanting surface and which, in the locking position of the slide, lies in a depression of the housing. In the case of this embodiment, the swiveling handle is developed in such a way, that its supporting part has an extension 2*b*.

Whenever the swiveling lever is refolded after having been unfolded in the case of the firing pin of the device lying in its uncocked position, the extension 2*b* engages the slanting surface of the slide, presses and slide into the housing 1 and thus again automatically locks the firing pin against any cocking movement.

Figure 6:
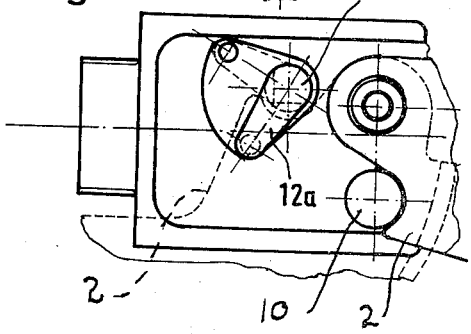
FIG. 6 is a view in the direction "E" of FIG. 3.

The method of operation and functioning of the device of FIGS. 1 and 7 is as follows. The handgun is generally stored in a folded position. First of all, the pressure plates 3*a* of the locking element 3 of the swiveling handle is pressed forward, so that it emerges from its position locking the unfolding movement of the swiveling handle 2 (see the presentation of the swiveling handle in FIG. 1 in a broken line). After that the swiveling handle 2 can be unfolded. At the end of the unfolding movement of the swiveling handle 2 (which in its folded position covers up the trigger), the locking knobs 10, fitting agianst the inside walls of the swiveling handle 2, are released. They move outward under the pressure of the spring 11 and hold the swiveling handle 2 firmly in its unfolded position (FIG. 6). As a result of the shifting of the locking knobs 10 to the outside, the cocking movement of the triggering slide is accommodated. Prior to pulling back of the cocking trigger 8, however, the safety member 12 (or 13 in FIG. 7) still locks the return movement of the firing pin 4. By transferring the safety member into the release position, the firing pin can be cocked by the latch 9. After sufficient movement of the latch 9 wherein it overrides the gliding surface 1*d*, the firing pin 4 cams the latch down and the shot is fired.

In the case of a third embodiment given by way of example according to FIGS. 10 to 14, viewed generally, the construction of the device is generally the same, so the same parts are given the same reference number as in the example 1 according to FIG. 1. The divergent locking member in this case has the reference No. 23. The firing pin spring 6 is guided with its front part in the recess of the firing pin 4 and with its rear part by a guiding extension of the locking member 23. In the case of storing of the device, said spring is completely or almost completely relieved.

Figure 10:
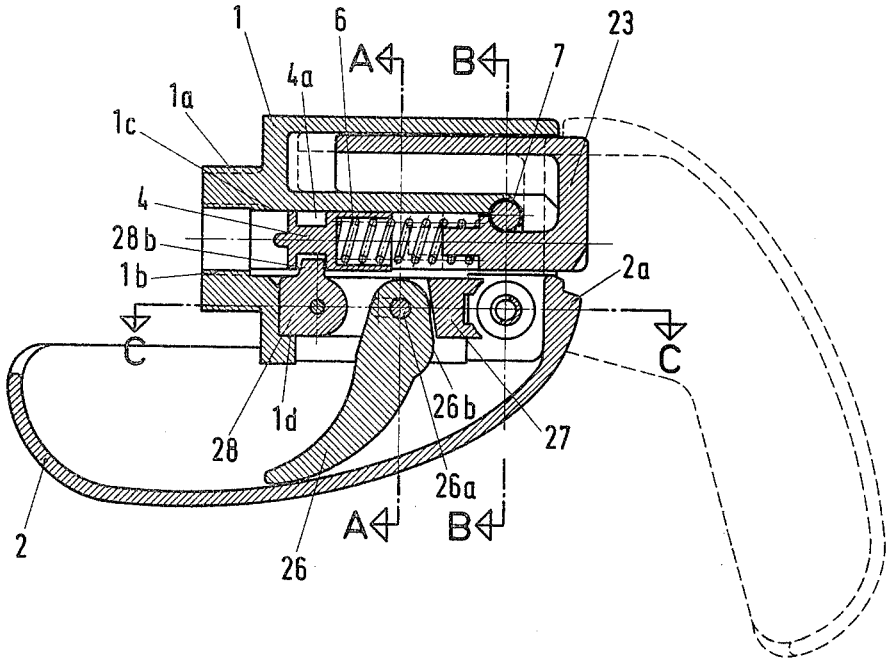
FIG. 10 is a longitudinal section through an additional embodiment of the handgun by way of example, with an unfolded swiveling handle indicated by broken lines and a folded swiveling handle indicated by solid lines.
Figure 11:
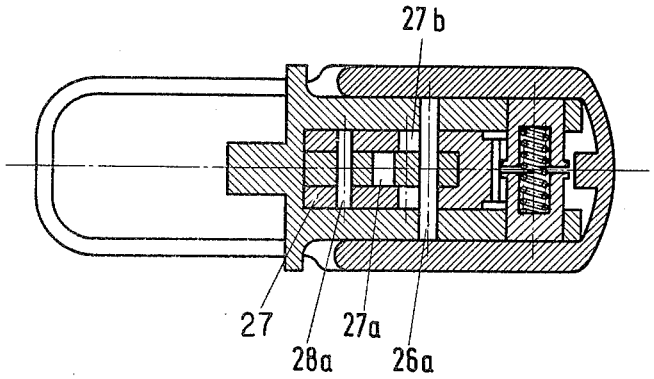
FIG. 11 is a horizontal longitudinal section along line C—C of FIG. 10.
Figure 12:
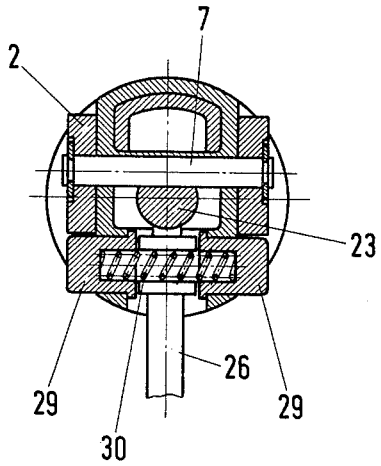
FIG. 12 is a cross section along line B—B of FIG. 10.
Figure 13:
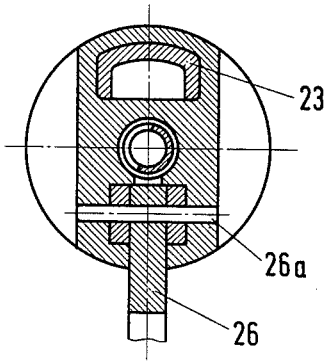
FIG. 13 is a cross section along line A—A of FIG. 10.

The swiveling handle 2 has a projection 2*a* which, upon unfolding of the swiveling handle 2, acts on the rear surface of the locking member 23 and pushes the locking member forward while cocking the firing pin spring, and holds it firmly in the case of the readiness-for-firing position of the swiveling handle 2 — shown in a broken line in FIG. 10. In the folded position, the swiveling handle 2 is blocked by two stop knobs 29 (FIG. 12), which are under the effect of a compression spring 30 disposed between them and which are supported by the inside lateral walls of the swiveling handle when the swiveling handle 2 is in a folded position against the housing 1. The locking knobs consist of plastic or metal and have the shape of a cup.

The outside release trigger has been developed as a manually actuable release lever 26, which can be swiveled around a swiveling axle 26*a* mounted in the housing 1. The release lever 26 has an eccentric curved surface 26*b* which acts on a release slide 27, the latter being shiftable in a direction parallel to the guide bore 1*c* for the firing pin. The release lever 26 penetrates a middle slit 27*a* of the release slide 27, in which elongated holes 27*b* have been disposed through which the swiveling axle 26*a* of the release lever 26 projects. The release slide 27 in its front part has a locking or latch member 28 which can be swiveled around an articulated axle 28*a*. The latch 28 in its locking position has a locking projection 28*b* that engages a safety annular groove 4*a* of the firing pin 4. In the front position of the release slide 27, the latch is supported by a gliding surface 1*d* of the housing 1, which surface is closed in front. In the case of the swiveling handle 2 being folded against the housing 1 — or not having been completely unfolded — the release slide 27 is secured a rearward movement by locking knobs 29.

The method of operation and functioning of the device of FIG. 10 is as follows. First of all, the locking member 23 for the swiveling handle is pressed forward, so that it comes out from its position locking the handle in its folded position. After that, the swiveling handle 2 is unfolded. At the same time, the extension 2*a* of the swiveling handle 2 forces the locking member further forward to cock the firing pin and its spring 6. After unfolding of the swiveling handle 2 into the gripping and firing position, the locking knobs 29 move outward and block the swiveling handle 2 against any swiveling-back. As a result of the shifting of the locking knobs 29 to the outside, the locking of the release slide 27 against rearward movement is released simultaneously. After that the shot can be released by pulling of the release lever 26, at which time the locking member 28 slides off the gliding surface 1d and is swung out downwards under pressure from the firing pin spring 6, so that the projection 28*b* of the locking member 28 will release the firing pin. Since the firing pin is cocked by the fixing member 23, there need by very little cocking action provided by the member 28. Consequently, the gliding surface 1d can be relatively short.

If, instead of firing a shot, it is desired to refold the gun, then the knobs 10 can be depressed, allowing the handle to be swivelled to its folded position. In so doing, it cams the fixing member 3 or 23 inwardly. Eventually, the fixing members spring rearwardly to lock the handle in its folded position. To accommodate the folded position of the handle, the bolt 12 is rotated to its safety position. This can be accomplished by the handle itself which can movably engage the lever 12*a*. Similarly, in the FIG. 7–9 embodiment the slide extension 13*a* can be cammed inwardly by the handle.

In consequence of the relatively small force which is present because of the relationship of the lever arm between the swiveling axle 26*a* and the point of attack of the finger of the marksman on the one hand and between the swiveling axle 26*a* and the point of attack of the eccentric curved surface 26*b* of the releasing lever 26, attacking at the release slide 27 on the other hand, the deflection of the direction of the shot from the straight line of the target can be considerably reduced upon releasing (firing) a shot. That is, the trigger-actuating force has a greater moment arm than the force which resists trigger movement. Thus, the gun can be fired with little difficulty, thereby minimizing the likelihood of the gun being moved upon firing. Moreover, since the trigger is not required to cock the firing pin, only minimal tension need by exerted by the shooter, thereby further lessening the chances for a wayward shot being fired.

The control device according to the drawing consists for the greatest part of simply formed plastic extrusion molded parts and standard parts which therefore can be produced cheaply. All plastic parts are produced effectively from UV-stabilized material which maintains its chemical and technical strength characteristics even at temperatures from −50° to +100°C.

BRIEF SUMMARY OF ADVANTAGES

It will be realized that the disclosed handgun provides numerous advantages in the way of safety. The handle 2, while in its folded position, blocks access to the trigger and presses the stop knobs inwardly to prevent trigger movement. The releasable locking member (3, 23) holds the handle in its folded position. The latch 9 retains the firing pin in a fixed position while the trigger is prevented from actuation. Also, the safety 12, 13 prevents cocking of the firing pin no matter what the position of the handle 2. While the handle 2 is in its folded position, the firing pin is held in an uncocked position, thereby relieving fatigue of the spring during storage of the handgun. Thus, the gun is maintained uncocked prior to unfolding of the handle, with little chance being present for unintended firing of the gun.

In the case where the locking member 23 cocks the spring, there need be little pressure imposed on the trigger to fire a shot, thereby minimizing the danger of a wayward shot being fired. Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a handgun for firing projectiles, the handgun including a housing having a bore, a firing pin mounted in said bore, a spring in said bore behind the firing pin for biasing the firing pin, a trigger for releasing the firing pin, and a handle pivoted to the housing for swinging movement between a folded position wherein the handle covers the trigger and an unfolded position wherein the trigger is uncovered; the improvement comprising:

releasable locking means on said housing for locking said handle in its folded position, said locking means including a guide portion shiftably disposed in said bore;

said guide portion engaging a rear end of said spring and forming a guide for said spring rear end;

a pair of knobs projecting from opposite sides of said housing; and a knob-biasing spring operably connected to both of said knobs to bias said knobs outwardly;

said knobs being biased inwardly by inside lateral walls of said handle when said handle is in its folded position, and being biased to an outward position by said knob-biasing spring when said handle is in its unfolded position to retain said handle in its unfolded position.

2. A handgun according to claim 1 wherein said locking means further includes a pressure plate at its rear end which is arranged to close the rear end of said housing; said pressure plate having a rear side of arc-shaped construction capable of being cammed inwardly by said handle during movement of said handle toward said folded position.

3. A handgun according to claim 1 further including an axle for pivotally mounting said handle; said axle extending through said housing and through an extended recess of said locking means to limit the forward and rearward extent of travel of said locking member.

4. A handgun according to claim 1 wherein said trigger is slidably mounted in said housing such that rearward movement thereof cocks said firing pin; said knobs being arranged, when biased inwardly by said handle, to block said trigger from said rearward cocking movement.

5. A handgun according to claim 4 wherein said trigger includes a manually engageable portion and a latch pivoted to a forward end of said manually engageable portion, said latch including a projection which is engageable within an annular groove of said firing pin; said projection including a rear surface which is engageable with a rear surface of said annular groove to cock said firing pin upon rearward movement of said trigger; said latch being supported by a guide surface of said housing for a portion of the rearward cocking movement of said trigger; one of said rear surfaces of said projection and said groove being beveled to enable said cocked firing pin to cam said latch out of engagement therewith once said latch has been shifted free of said guide surface.

6. A handgun according to claim 4 wherein said trigger includes a recess at its rearward end to receive said knob-biasing spring when said trigger is in a position cocking said firing pin.

7. A handgun according to claim 1 and further including safety means attached to said housing for securing said firing pin against rearward cocking movement when said handle is in an unfolded position.

8. A handgun according to claim 7 wherein said safety means comprises a bolt which is rotatable within said housing, said bolt including a securing portion and a lever portion, said lever portion being arranged to rotate said securing portion between a first position wherein said firing pin is locked against cocking movement and a second position wherein said firing pin is free to be shifted into cocking movement; said handle being arranged, when in its folded position, to prevent rotation of said lever to unlock said firing pin.

9. A handgun according to claim 7 wherein said safety means comprises a slide having a first position for locking said firing pin against cocking movement and a second position for freeing said firing pin for cocking movement; said slide including a slanting surface arranged to be contacted by said handle when said handle is moved to a folded position to shift said slide into said first position; and a leaf spring arranged to releasably retain said slide in both of said first and second positions.

10. A handgun according to claim 1 wherein said handle includes a portion which cams said locking means inwardly to cock said spring when said handle is moved toward an unfolded position, and for retaining said locking means in its spring-cocking position when said handle is situated in its unfolded position.

11. A handgun according to claim 10 wherein said firing pin includes an annular groove engaged by a projection of said trigger.

12. A handgun according to claim 10 wherein said handle is pivotally mounted upon an axle; said axle projecting through a recess in said locking means to limit the extents of movement of said locking means.

13. A handgun according to claim 10 wherein said trigger comprises a manually actuable portion pivoted to said housing, a slidable portion mounted for sliding movement relative to said housing, and a latch pivotally mounted at the front of said slidable portion; and manually actuable portion being pivotally mounted for engagement with said slidable portion such that rotation of said manually actuable portion produces sliding movement of said slidable portion; said latch being supported for a portion of the sliding stroke of said slidable portion by a guiding surface of said housing; said latch being engageable with said firing pin such that rearward sliding movement of said slidable portion causes said latch to cock said firing pin until movement of said driver past said guiding surface enables said cocked firing pin to pivot said latch out of engagement with said firing pin to release said firing pin.

14. A handgun according to claim 13 wherein said manually actuable portion is mounted for pivotal movement within a recess formed in said slidable portion.

15. A handgun for firing projectiles comprising:

a housing;

a firing pin slidable in said housing;

a spring for biasing said firing pin forwardly;

trigger means including a manually actuable portion, and a movable latch engageable with said firing pin to prevent relative movement therebetween;

means for restraining movement of said latch toward disengagement from said firing pin prior to actuation of said manually actuable portion, and allowing such disengagement after pre-selected movement of said manually actuable portion;

a handle pivotally mounted to said housing for movement between a folded position and an unfolded position;

stop means for locking said trigger means against actuation when said handle is in its folded position and for allowing such trigger actuation when said handle is in its unfolded position said stop means comprising:

a pair of knobs projecting from opposite sides of said housing; and a knob-biasing spring operably connected to both of said knobs to bias said knobs outwardly;

said knobs being biased inwardly by inside lateral walls of said handle when said handle is in its folded position to prevent actuation of said trigger means, and being biased to an outward position by said knob-biasing spring when said handle is in its unfolded position to retain said handle in its unfolded position; and releasable cocking means for locking said handle in its folded position.

16. A handgun according to claim 15 wherein said latch is arranged, when said handle is unfolded, to cock said firing pin during actuation of said trigger means.

* * * * *